US010624434B2

(12) United States Patent
Josifov

(10) Patent No.: US 10,624,434 B2
(45) Date of Patent: Apr. 21, 2020

(54) PIECE OF LUGGAGE, ESPECIALLY A SUITCASE

(71) Applicant: Martin Josifov, Köln (DE)

(72) Inventor: Martin Josifov, Köln (DE)

(73) Assignee: Martin Josifov, Köln (DE)

( * ) Notice: Subject to any disclaimer, the term of this patent is extended or adjusted under 35 U.S.C. 154(b) by 222 days.

(21) Appl. No.: 15/617,865

(22) Filed: Jun. 8, 2017

(65) Prior Publication Data

US 2018/0352930 A1 Dec. 13, 2018

(51) Int. Cl.

| | |
|---|---|
| ***A45C 13/42*** | (2006.01) |
| ***B32B 1/02*** | (2006.01) |
| ***A45C 5/03*** | (2006.01) |
| ***A45C 13/26*** | (2006.01) |
| ***A45C 5/02*** | (2006.01) |
| ***A45C 13/00*** | (2006.01) |
| ***A45C 13/18*** | (2006.01) |

(52) U.S. Cl.

CPC ..... *A45C 13/42* (2013.01); *A45C 5/02* (2013.01); *A45C 5/03* (2013.01); *A45C 13/00* (2013.01); *A45C 13/002* (2013.01); *A45C 13/18* (2013.01); *A45C 13/26* (2013.01); *A45C 2005/037* (2013.01)

(58) Field of Classification Search

CPC ..... A45C 5/02; A45C 5/03; A45C 13/002; A45C 13/08; A45C 13/42; A45C 13/00; A45C 13/18; A45C 2005/037; B32B 1/02

See application file for complete search history.

(56) References Cited

FOREIGN PATENT DOCUMENTS

| | | |
|---|---|---|
| DE | 20 2013 002 980 U1 | 8/2014 |
| DE | 20 2015 004 580 U1 | 9/2016 |
| DE | 10 2015 008 221 B4 | 5/2017 |

OTHER PUBLICATIONS www.flyertalk.com/forum/travel-products/1430056-any-pics-user-rimowa-stealth-topas-bags.html, FlyerTalk Forum>TravelDining>Travel Products, Published Jan. 21, 2013 (14 pgs).

*Primary Examiner* — Walter Aughenbaugh

(74) *Attorney, Agent, or Firm* — Pauley Erickson & Kottis

(57) ABSTRACT

A piece of luggage, especially a suitcase with a container where the container features or has on one exterior side a base layer and at least one cover layer. An easily customizable piece of luggage is provided, where the container features on one exterior side a base layer and at least one cover layer. The base layer and at least one cover layer, respectively, being non-transparent and of various colors, where the cover layer is formed from an abradable material, where at least one cover layer features a lower resistance to abrasion than the base layer, where through traces of use at least one cover layer is at least partially abradable so that the subjacent base layer and/or each subjacent base layer may be exposed in the area of the traces of use and at least one motif template positioned between the outer cover layer and the base layer, where the motif template facilitates a detachment of the outer cover layer in the shape of the motifs formed by the motif templates.

20 Claims, 3 Drawing Sheets

PIECE OF LUGGAGE, ESPECIALLY A SUITCASE

BACKGROUND OF THE INVENTION

Field of the Invention

This invention relates to a piece of luggage as described in the preamble of the patent claims, particularly a suitcase designed as a travel suitcase.

Discussion of Related Art

Suitcases are known, for example, as hard shell suitcases having at least two suitcase shells which form a container and are connected by a hinge on one side, while they can be detachably connected to each other on another side by a closing device. The hard shells are especially made of vacuum-formed thermoplastic plates, respectively an acrylonitrile butadiene styrene (ABS) polymer. In order to make these heat-formed shell parts abrasion resistant, it is common to laminate an imprinted wrapping film made of a particularly abrasion resistant material to the ABS thermoplastic substrate. The substrate forms a base layer, while the wrapping film forms a cover layer with a higher abrasion resistance than the base layer. Furthermore, hard shell suitcases are known, in which the suitcase shell parts are made of a polycarbonate material. Such hard shell suitcases generally feature a monochrome exterior surface. In order to avoid traces of use on the exterior surface of the suitcase, according to the state of the art, the exterior surfaces, that is the respective cover layers of the suitcase shell parts, are made from a material which is as abrasion resistant as possible. Furthermore, suitcases made of aluminum are known.

Furthermore, a hard shell suitcase, especially made from aluminum or plastics, is known from German Utility Model Specification DE 20 2013 002 980 U1. This hard shell suitcase features three-dimensional protrusions that stand out from the outer surface and formed by at least two successive layers which are connected with each other. These layers may, for example, be imprinted. These layers may feature varying colors. The color design of a three-dimensional protrusion may be influenced by way of the colors. For example, shadows may be portrayed through the use of dark colors. As an example, the lowest layer may feature the darkest color. These layers are formed under an additional exterior layer which means that the imprinted rib-like protrusion is protected accordingly by the exterior layer. On the web page www.flyertalk.com/forum/travel-products/1430056-any-pics-user-rimowa-stealth-topas-bags.html, published on Jan. 21, 2013, it is described that scratches on the surface of a hard shell suitcase are especially easily visible, because a black coat of lacquer, in optical terms, particularly accentuates the scratches in the aluminum base layer.

Also, in order to avoid damage to the suitcase and unintended opening of the suitcase during transport, additional services for the protection of baggage are offered at airports. For instance, a service is offered to wrap the suitcase in film.

The suitcases known in the state of the art have not yet been optimally designed. The traces of use resulting from prolonged use of the suitcase are generally not desired by the user. This generally causes the user of the suitcase to exchange the suitcase for a newer model, even though the old suitcase is still functional, despite it showing respective traces of use. Furthermore, known suitcases have one disadvantage that the suitcases are individualized, for reasons of improved recognizability, with additional measures, such as luggage straps, or the application of adhesive labels or signs, or similar measures, so that the user of the suitcase can more easily recognize his or her suitcase, such as at the baggage transport conveyor belt.

SUMMARY OF THE INVENTION

One object of this invention is to design and further develop the initially mentioned piece of luggage to provide an easily customizable piece of luggage.

This object and others, which form the basis of this invention, are solved by having a piece of luggage with the characteristics as described in this specification and in the claims.

The piece of luggage features a base layer and at least one cover layer applied on top of the base layer. The cover layer is not transparent but opaque. The cover layer and the base layer feature varying colors at least in some areas. Especially the cover layer presents itself in a hue complementary to that of the base layer. The cover layer features a lower abrasion resistance than the base layer. Depending on their respective depth and width, the traces of use resulting from use reach layers of various colors, resulting in various hues becoming visible, which in turn results in the creation of individual color schemes on the exterior surface through abrasion of at least one cover layer. A piece of luggage is created with an exterior surface showing varying color schemes on the surface by the varying depths and widths of the traces of use, thus showing a customization. Through the abradability of the last cover layer or, respectively, cover layers and their varying colorations, scratches and other marks are more easily generated and are easily visible in order to emphasize the individuality of the piece of luggage for travel. The "history" of the piece of luggage for travel is easily visible in form of the traces of use.

The piece of luggage is preferably designed as a suitcase, especially a hard shell suitcase. The container is formed by at least one suitcase shell, where one exterior side of at least one suitcase shell forms the base layer, where at least one cover layer is applied on top of the base layer. During use, various layers are revealed through the various depths and widths of the abrasion traces, such as the traces of use, resulting in the creation of an individual coloration of the suitcase. The lower abrasion resistance of the cover layer, especially in comparison with the base layer, ensures the creation of additional traces of use on the exterior surface of the suitcase. The design resulting from the traces of use is always individual and easily recognizable, since subsequent layers of varying colors are formed on or attached to the exterior surface of the suitcase.

Several cover layers in varying colors are preferably provided. Each of the cover layers features a lower abrasion resistance than the base layer. All cover layers preferably feature varying colors, while none of the cover layers preferably feature the color of the base layer. Adjacent cover layers feature varying colors. The cover layer applied to the base layer features a different color than the base layer.

It is possible for the cover layers to be of layers of paint. It is possible for the base layer to be applied through a color layer, such as through powder coating. The cover layers could for example be applied through powder coating, painting, or similar means. It is possible for at least one of the cover layers to be formed from a textile material with a low abrasion resistance. It is possible for at least one of the cover layers to be formed from an easily tearable film. In an alternative design of this invention, at least one cover layer can be formed from an affixed layer of paper.

In an alternative design of this invention, the base layer can consist of or be of a textile layer. This textile layer features especially a higher abrasion resistance than the overlying textile cover layers. It is possible for the cover layer and the base layer to be applied through lamination.

The preferred design of the suitcase is that of an aluminum suitcase. In this case, the base layer can be tinted through anodizing of the aluminum shells. The overlying cover layer, respectively overlying cover layers are especially produced through an application of paint.

BRIEF DESCRIPTION OF THE DRAWINGS

There are now a number of possibilities to further design and further develop the piece of luggage according to this invention. For this purpose, the dependent claims are referred to initially. The following describes a preferred design of the piece of luggage in accordance with this invention by the drawing and the associated description.

DETAILED DESCRIPTION OF THE INVENTION

Figure 1:
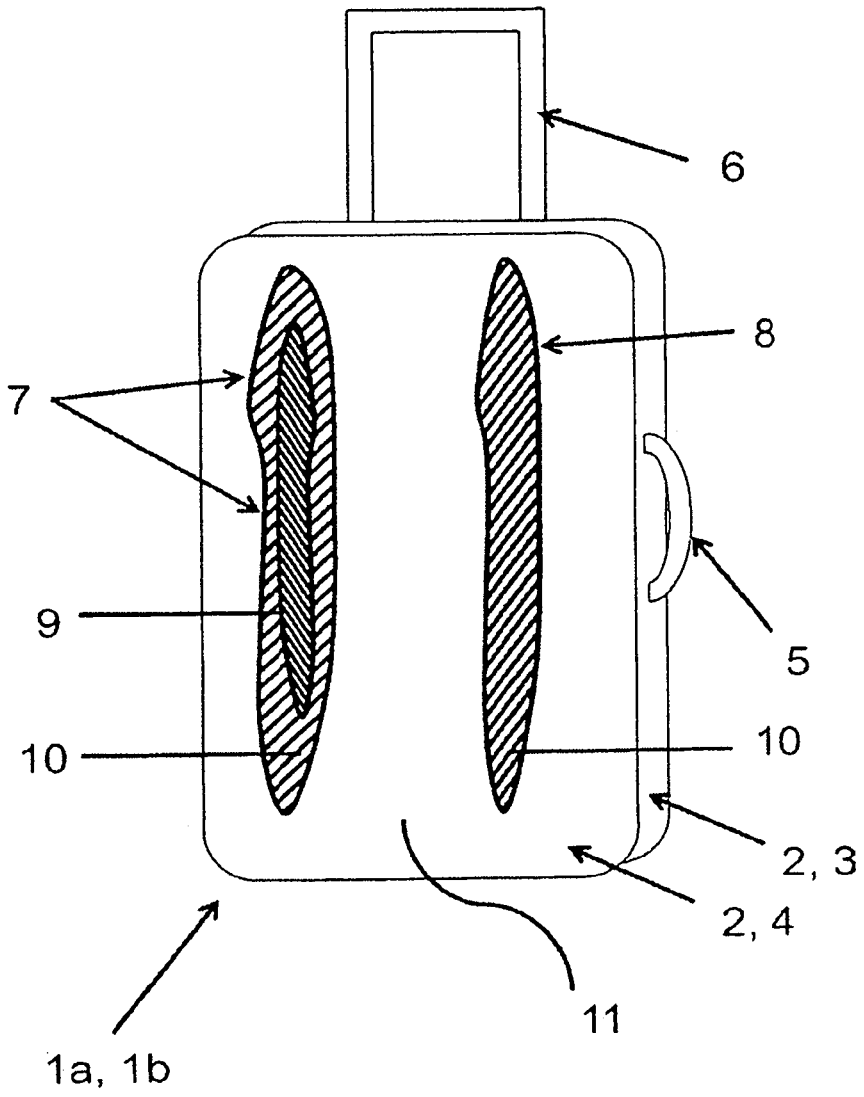
FIG. 1 shows a piece of luggage in accordance with this invention in a schematic, perspective view, that is a suitcase.
Figure 2:
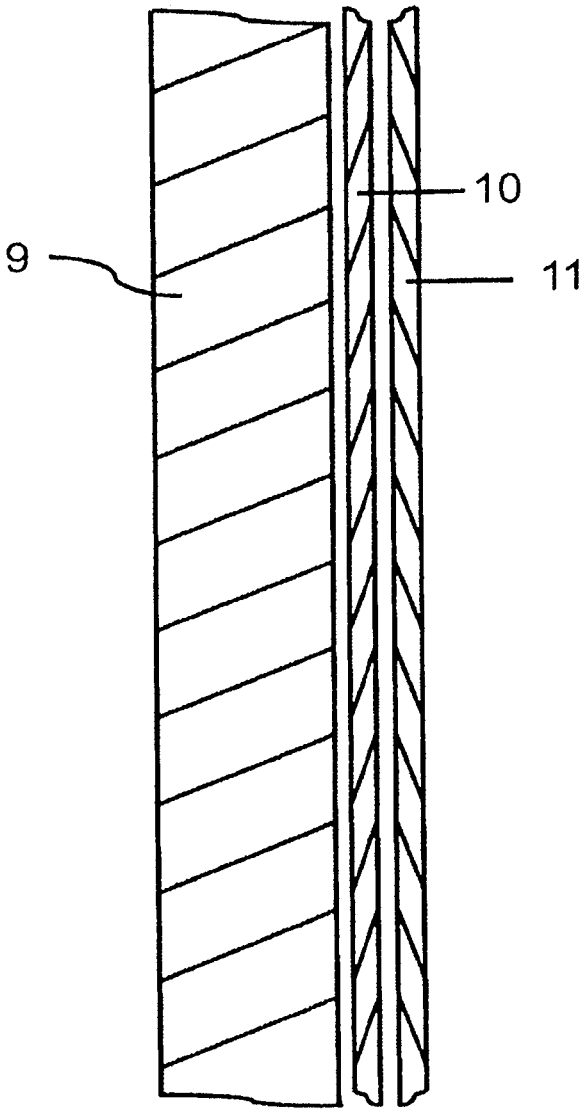
FIG. 2 shows an exterior wall of the suitcase with two cover layers and a base layer, in a cutaway detailed view.

FIG. 1 shows a piece of luggage 1*a* in the form of a suitcase 1*b*. The piece of luggage 1*a* is in the form of a piece of luggage for travel. The suitcase 1*b* is in the form of a suitcase for travel. In an alternative design, the piece of luggage 1*a* can have the form of a bag or backpack.

The suitcase 1*b* features a container 2. Container 2 limits the interior space, not shown in detail, of suitcase 1*b*. Container 2 is preferably formed by at least one hard shell 3, 4, especially by two hard shells 3, 4. FIG. 1 shows a posterior hard shell 3, and a carrying handle 5 is placed on an unidentified longitudinal side, while a telescopic handle 6 is placed on a top face. Furthermore, suitcase 1*b* preferably features at least one, especially several rollers which are not shown. The rollers are especially placed on the lower face, preferably in the area of the edges.

Suitcase shells 3, 4 are preferably made from a polycarbonate material. In an alternative design, it is possible for suitcase shells 3, 4 to be made from aluminum. Furthermore, designs are possible where the suitcase shells 3, 4 are vacuum formed from a thermoplastic material such as an ABS polymer.

Container 2 features several traces of use 7, 8. The traces of use 7, 8 in the area of the largest outer wall show that suitcase 1*b* features one base layer 9 and at least one cover layer 10, 11, preferably two cover layers 10, 11 as shown, on the exterior side of container 2. The cover layers 10, 11 are applied to the shaping wall of the container 2. The cover layers 10, 11 are applied to the exterior side of the wall. This base layer 9 and the cover layers 10, 11 are preferably especially formed on and applied to the two largest exterior surfaces of the piece of luggage 1*a* or the suitcase 1*b*. Furthermore, it is possible for the cover layers 10, 11 to be alternatively or additionally formed on the edges or corners of the suitcases 1*b*, as these edges and corners are more heavily worn during transport.

The base layer 9 and the cover layers 10, 11 each feature varying colors. At the same time, adjacent cover layers feature varying colors. The base layer 9 and the cover layers 10 and 11 form differently colored consecutive layers on the exterior surface of suitcase 1*b*. The cover layers 10, 11 are not transparent but opaque.

The cover layers 10, 11 consist of or include an abradable material. The traces of use 7, 8 generated during use reach differently colored layers depending on their depth and thickness, such as here, in the case of trace of use 8, cover layer 10 is subjacent to cover layer 11, and in the case of trace of use 7, cover layer 10 subjacent to cover layer 11, as well as base layer 9. These traces of use 7, 8 render the various layers of color visible, generating an individual color scheme on the exterior surface through abrasion of the upper cover layer 10, respectively the upper cover layers 10, 11. The traces of use 7, 8 are desired and serve to individualize the suitcase. The abradability of the upper cover layers 10, 11 and their different coloration more easily generate scratches, abrasions, and other traces of use 7, 8 in order to highlight the individuality of the piece of luggage (for travel) 1*a*, that is, suitcase 1*b*. The traces of use 7, 8 for example are inadvertently generated during transport of the piece of luggage 1*a*. It is however also possible for the user or owner of the piece of luggage 1*a* fashions said piece of luggage 1*a* himself or herself through artificial traces of use 7, 8. The user may, for example, treat the exterior side with its cover layers 10, 11 through scratching, scouring, or grinding in order to at least partially detach cover layers 10, 11 from the exterior side and thus to obtain an individual design.

The cover layers 10, 11 feature varying colors and consist of or include an abradable material, such as paint or a synthetic material. During use, the abrasion traces or traces of use 7, 8 with their varying depths and widths reveal a varying number of layers, resulting in an individual coloration of suitcase 1*b*.

The base layer 9 is formed by the form-giving, firm exterior wall of suitcase 1*b*. The base layer 9 is part of the suitcase shell 3 or 4. Two cover layers 10, 11 are applied to the base layer 9 that is one inner colored cover layer 10 and one outer cover layer 11. Both the inner cover layer 10 and the outer cover layer 11 are abradable. For example, the abrasion resistance or abrasion durability of the cover layers 10, 11 is lower than the abrasion durability of base layer 9.

The base layer 9 may contain several colors. It is possible for also the cover layers 10, 11 to contain several colors. Especially, the base layer 9 or the cover layers 10, 11 may contain several colors.

It is possible for the base layer 9 and/or the cover layers 10, 11 to feature motifs. However, the outer cover 11 is preferably monochrome, such as a single color. Especially the color layers underneath the outer cover layer 11, that is cover layer 10 or base layer 9 features motifs. In one design, exactly one cover layer 11 and one base layer 9 may be present, where the base layer 9 features motifs.

In the unused state of suitcase 1*b*, the motifs are preferably not visible since the outer cover layer 11 is not transparent, thus covering the motifs. The motifs become visible only through the traces of use 7, 8 that are generated during use.

It is possible for suitcase 1*b* to be sold with already existing traces of use 7, 8. The traces of use 7, 8 will be generated during production of suitcase 1*b*. The traces of use 7, 8 can be generated through scouring, grinding, or sandblasting.

Figure 3:
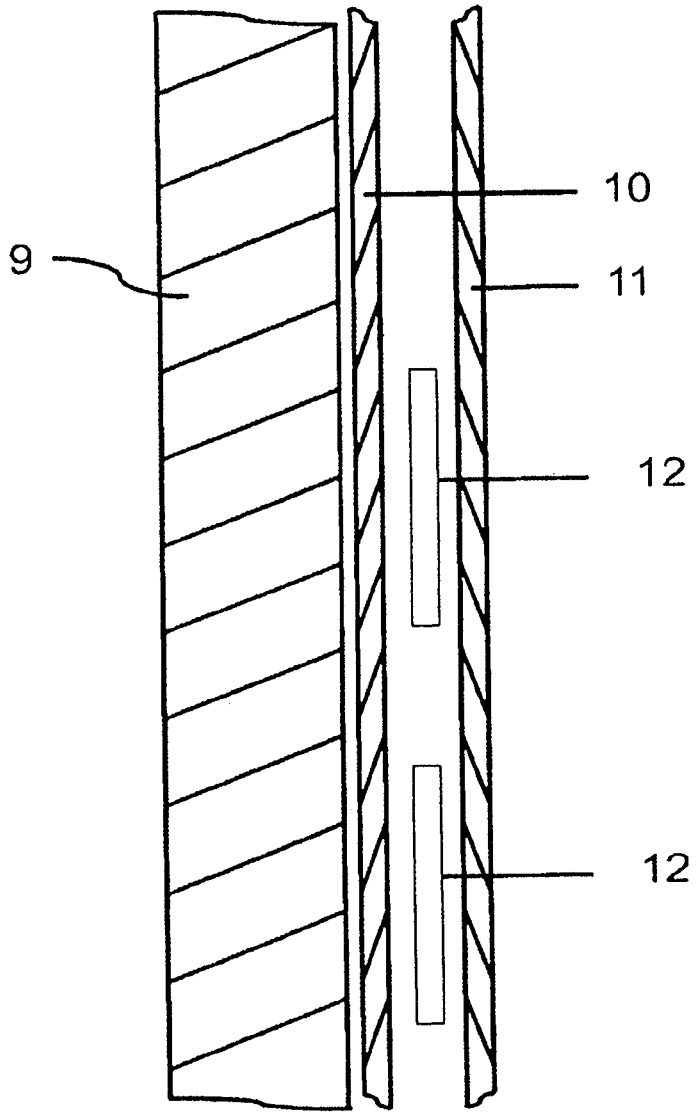
FIG. 3 shows the exterior wall of the suitcase with two cover layers of the base layer and motif templates arranged between the cover layers, in a schematic cutaway view.

In order to facilitate removal of the outer cover layer 11, at least one so-called motif template 12 is preferably arranged between the outer cover layer 11 and the base layer 9, or, as shown in FIG. 3, between the outer cover layer 11 and the middle cover layer, respectively inner cover layer 10. Preferably, several motif templates are present.

The motif templates 12 delineate the outline of the motif to be displayed. The motif template 12 preferably has a weaker bond with the adjacent layers than the layers among themselves. The bonds between cover layers 10, 11 and motif template 12 are especially weaker than the bond between cover layers 10, 11. There are now different possibilities of how the motif is generated by the traces of use 7, 8. In one design, it is possible for the cover layers 10, 11 and/or the base layer 9 to each be different monochrome colors, so that during use of suitcase 1*b* at least the outer cover layer 11 detaches in such places where the motif template is present. This way, the motif templates 12 become visible.

It is possible for the motif templates 12 to be bonded to the subjacent inner cover layer 10 in an easily detachable manner, so that the motif templates 12 also detach from the middle cover layer 10 as soon as the outer cover layer 11 is damaged in places where the motif templates 12 are present. This facilitates the detachment of the outer cover layer 11 in the shape of the motif. In this case, it is not compulsory for the subjacent cover layer 10 to feature the motif in the exact shape of the motif templates 12. Instead, the motif can be generated solely through detachment of the motif templates 12. In an alternative design, the inner cover layer 10 or the base layer 9 features a motif that is covered by the motif template 12. It is possible to also utilize corresponding motif templates 12 in designs in which exactly one outer cover layer 11 is stipulated. In this case, the motif template 12 is placed immediately between the outer cover layer 11 and the base layer 9. It is furthermore conceivable that several cover layers 10, 11 are present, and that the motif template 12 is not placed between the outer cover layer 11 and the subjacent cover layer 10, but between the base layer 9 and the first cover layer 10. The motifs may, for example, consist of or include various brands, logos, images, letterings, etc.

The disadvantages mentioned initially are thus avoided, while the relevant advantages are achieved.

The entire teachings of German Patent DE 20 2015 004 580 U1, filed 29 Jun. 2015, and German Patent DE 10 2015 008 221 B4, filed 29 Jun. 2015, are incorporated, by reference, into this specification.

What is claimed is:

1. A piece of luggage, comprising:

a container including a base layer forming or disposed over one side of the container;

a cover layer disposed over the base layer, each of the base layer and the cover layer being non-transparent and of one or more colors, the cover layer formed of an abradable material having a lower resistance to abrasion than the base layer, wherein the cover layer is configured to be at least partially abradable through use to expose the base layer in areas of traces of use; and a motif template disposed between the cover layer and the base layer, where the motif template facilitates a detachment of the cover layer in a shape of motifs formed by the motif template.

2. A piece of luggage in accordance with claim 1, wherein the piece of luggage is a suitcase.

3. A piece of luggage in accordance with claim 1, wherein the container comprises a suitcase shell, wherein one exterior side of the suitcase shell forms the base layer.

4. A piece of luggage in accordance with claim 1, wherein the base layer comprises an aluminum material, and the base layer is colored through anodization.

5. A piece of luggage in accordance with claim 1, wherein the cover layer comprises a layer of paint.

6. A piece of luggage in accordance with claim 1, wherein the cover layer comprises a textile material or a film.

7. A piece of luggage in accordance with claim 1, the base layer comprises a polycarbonate material.

8. A piece of luggage in accordance with claim 1, wherein the cover layer is an inner cover layer and further comprising an outer cover layer disposed over the inner cover layer, the outer cover layer formed of a second abradable material having a different color or color scheme from the inner cover layer.

9. A piece of luggage in accordance with claim 8, wherein the container is enclosed by a suitcase shell, wherein one exterior side of the suitcase shell forms the base layer, and where the inner cover layer is applied to the base layer.

10. A piece of luggage in accordance with claim 9, wherein the suitcase shell comprises a polycarbonate material.

11. A piece of luggage in accordance with claim 9, wherein the suitcase shell comprises an aluminum material, and the base layer is colored through anodization.

12. A piece of luggage in accordance with claim 9, wherein at least one of the inner cover layer or the outer cover layer comprises a layer of paint.

13. A piece of luggage in accordance with claim 9, wherein the inner cover layer or the outer cover layer comprises a textile material.

14. A piece of luggage in accordance with claim 9, wherein the inner cover layer or the outer cover layer comprises a film.

15. A piece of luggage, comprising:

a shell comprising a base layer and enclosing an interior container space;

a motif template disposed on the base layer of the shell, and comprising a motif shape;

an opaque outer cover layer disposed over the motif template, the outer cover layer formed of an abradable material having a different color than the base layer and configured to be at least partially abradable through luggage use in areas of traces of use to expose the base layer in the areas of traces of use, wherein the motif template facilitates a detachment of the outer cover layer in the motif shape of the motif template.

16. A piece of luggage in accordance with claim 15, wherein an exterior surface of the shell forms the base layer.

17. A piece of luggage in accordance with claim 16, wherein the base layer comprises a color anodized aluminum material.

18. The piece of luggage in accordance with claim 15, wherein the base layer comprises an inner cover layer disposed between the shell and the motif template, wherein the inner cover layer comprises an inner abradable material having a different color than the outer cover layer.

19. A piece of luggage, comprising:

a shell including an exterior surface and enclosing an interior container space;

an inner cover layer disposed on the exterior surface of the shell, and including a first color;

a motif template disposed on the inner cover layer, and comprising a motif shape;

an opaque outer cover layer disposed over the motif template, the outer cover layer formed of an abradable material having a second color that is different than the first color of the inner cover layer, the abradable material configured to be at least partially abradable through luggage use in areas of traces of use to expose the inner cover layer in the areas of traces of use, wherein the motif template is configured to facilitate a detachment of the outer cover layer in the motif shape of the motif template.

20. A piece of luggage in accordance with claim 19, wherein the exterior surface of the shell comprises a color anodized aluminum material.

* * * * *